US012588759B2

(12) United States Patent
Gregory

(10) Patent No.: US 12,588,759 B2
(45) Date of Patent: Mar. 31, 2026

(54) RETAINING BRACKET FOR MODULAR SHELVING UNIT

(71) Applicant: Virco Mfg. Corporation, Torrance, CA (US)

(72) Inventor: John Gregory, Enola, AR (US)

(73) Assignee: Virco Mfg. Corporation, Torrance, CA (US)

( * ) Notice: Subject to any disclaimer, the term of this patent is extended or adjusted under 35 U.S.C. 154(b) by 0 days.

(21) Appl. No.: 18/194,502

(22) Filed: Mar. 31, 2023

(65) Prior Publication Data

US 2024/0324775 A1 Oct. 3, 2024

(51) Int. Cl.
*A47B 96/06* (2006.01)
*A47B 47/00* (2006.01)

(52) U.S. Cl.
CPC ..... *A47B 96/06* (2013.01); *A47B 47/0091* (2013.01); *A47B 96/068* (2013.01)

(58) Field of Classification Search
CPC .... A47B 96/06; A47B 96/068; A47B 47/0091
See application file for complete search history.

(56) References Cited

U.S. PATENT DOCUMENTS 3,306,466 A * 2/1967 Liston ..... A47B 57/16 108/107
4,037,813 A * 7/1977 Loui ..... A47B 96/063 248/250
4,405,052 A * 9/1983 Spiros ..... A47B 57/04 211/187
4,432,523 A * 2/1984 Follows ..... A47B 57/30 248/250
4,513,669 A * 4/1985 Steinke ..... A47B 57/48 108/107
4,732,358 A * 3/1988 Hughes ..... A47B 96/068 211/90.01
4,735,325 A * 4/1988 Remmers ..... A47B 96/068 211/187
4,819,901 A * 4/1989 McDonald ..... A47B 57/52 248/250
4,830,323 A * 5/1989 Harley ..... A47B 96/063 248/250
4,856,746 A * 8/1989 Wrobel ..... A47B 96/063 108/107
4,909,465 A * 3/1990 Lyman ..... A47B 96/068 248/250

(Continued)

*Primary Examiner* — Stanton L Krycinski
(74) *Attorney, Agent, or Firm* — Knobbe, Martens, Olson & Bear, LLP

(57) ABSTRACT

Retaining brackets to fixedly secure either a singular modular shelving unit or multiple modular shelving units are disclosed. The retaining brackets can prevent modular shelves from dislodging, by positioning the retaining bracket such that an opening on the retaining bracket aligns with a mounting location on a vertical member of the modular shelving unit, and a distance between a retaining surface of the retaining bracket and a top surface of the modular shelf is small enough to prevent dislodging of the modular shelf when the retaining bracket is installed. The retaining surface of the retaining brackets can vary depending on the configuration used to retain the modular shelf, as well as the embodiment of the retaining bracket used.

16 Claims, 10 Drawing Sheets

(56) References Cited

U.S. PATENT DOCUMENTS

| | | | | | |
|---|---|---|---|---|---|
| 5,027,959 | A | * | 7/1991 | Luukkonen | A47B 47/021 211/186 |
| 5,195,708 | A | * | 3/1993 | Marsh | A47B 96/068 211/90.01 |
| 6,273,281 | B1 | * | 8/2001 | Berglund | A47B 57/50 108/147.11 |
| D604,152 | S | * | 11/2009 | Fernandez | D8/381 |
| D604,597 | S | * | 11/2009 | Fernandez | D8/381 |
| D604,598 | S | * | 11/2009 | Fernandez | D8/381 |
| D606,386 | S | * | 12/2009 | Fernandez | D8/381 |
| 8,118,181 | B2 | * | 2/2012 | Shinozaki | A47B 47/0083 211/208 |
| 10,165,854 | B2 | * | 1/2019 | Lim | F16B 12/34 |
| 10,342,346 | B2 | * | 7/2019 | Hansen | A47B 96/067 |
| D891,229 | S | * | 7/2020 | Hohmann, Jr. | D8/354 |
| 11,690,446 | B2 | | 7/2023 | Harrison | |

* cited by examiner

RETAINING BRACKET FOR MODULAR SHELVING UNIT

BACKGROUND OF DISCLOSURE

Modular shelving units are generally comprised of modular shelves which slot into or rest upon structural components that define the footprint of and provide rigidity to an organizing system. Currently, shelving units are mostly connected to the structural members of an organizing system by relying on gravity to hold the modular shelf in place, or by directly mechanically connecting the modular shelf to the structural components. Additionally, modular shelving units frequently need to be connected to each other in series, something which requires additional fasteners.

FIELD

The present disclosure is generally related to modular organizers for storage, and more particularly to retaining brackets which can be added to a modular shelving unit and the like for added safety and security.

SUMMARY OF THE DISCLOSURE

Considering the current methods of connecting modular shelving units to their organizing systems, there is a need for a secure connection method to secure modular shelves to modular shelving units while overcoming the issues inherent with current connection methods The present disclosure provides embodiments of a retaining bracket that is applicable to securing stand alone modular shelving units or when used in series.

The embodiments, examples and alternatives described herein with respect to the description, drawings, and claims, including any of their various aspects or respective individual features, may be taken independently or in any combination. Features described in connection with one embodiment are applicable to all embodiments, unless such features are incompatible.

In some aspects, the techniques described herein relate to a retaining bracket including: a body portion, including a distal end having a securing interface, wherein the securing interface is configured to interface with a modular shelving unit to couple the body portion to the modular shelving unit with a mechanical coupling mechanism, and a head portion located at a proximal end of the body portion, the head portion including at least one retaining arm extending substantially perpendicular relative to the body portion, for connecting a modular shelf to the modular shelving unit with a multitude of retaining arms, wherein when the at least one retaining arm is configured to prevent a modular shelf from dislodging from a vertical support member of the modular shelving unit.

In some aspects, the techniques described herein relate to a retaining bracket, wherein a retaining surface of the retaining bracket is configured to prevent the modular shelf from dislodging from the vertical support member.

In some aspects, the techniques described herein relate to a retaining bracket, wherein the retaining surface of the retaining bracket is a is a top surface of the body portion of the retaining bracket.

In some aspects, the techniques described herein relate to a retaining bracket, wherein the retaining surface of the retaining bracket is a bottom surface of the at least one retaining arm.

In some aspects, the techniques described herein relate to a retaining bracket, wherein the securing interface is an opening that extends between a front surface and a back surface of the body portion.

In some aspects, the techniques described herein relate to a retaining bracket, wherein the retaining bracket is symmetrical about a center axis, and wherein the at least one retaining arm includes a first retaining arm and a second retaining arm.

In some aspects, the techniques described herein relate to a retaining bracket, wherein a transition portion between the at least one retaining arm and the body portion is rounded with a radius of curvature.

In some aspects, the techniques described herein relate to a retaining bracket, wherein the retaining bracket is configured to couple with the modular shelving unit using a fastener.

In some aspects, the techniques described herein relate to a retaining bracket, wherein the securing interface couples with a complementary securing interface on the modular shelving unit, wherein a distance between a retaining surface of the retaining arm and a top surface of the modular shelf prevents dislodging of the modular shelf In some aspects, the techniques described herein relate to a retaining bracket, wherein an angle formed between the at least one retaining arm and the body portion is between about 88 and 92 degrees.

In some aspects, the techniques described herein relate to a method of securely attaching a modular shelf to a modular shelving unit, including: coupling the modular shelf to a plurality of vertical support members of the modular shelving unit, orienting a securing interface of a retaining bracket with a complementary securing interface of a vertical support member of the modular shelving unit such that at least one retaining arm of the retaining bracket extends above at least a portion of a top surface of the modular shelf, coupling the retaining bracket to the vertical support member of the modular shelving unit, wherein a distance between a retaining surface of the at least one retaining arm and the top surface of the modular shelf prevents removal of the modular shelf from the vertical support member.

In some aspects, the techniques described herein relate to a method, wherein the retaining surface of the retaining bracket is a retaining arm bottom surface.

In some aspects, the techniques described herein relate to a method, wherein the retaining surface of the retaining bracket is a top surface of retaining arm.

In some aspects, the techniques described herein relate to a method, wherein the method of securing the modular shelf to the modular shelving unit is repeated so that there is a plurality of retaining brackets securing the modular shelf.

In some aspects, the techniques described herein relate to a method further including attaching a first modular shelf and a second modular shelf to a first modular shelving unit and a second modular shelving unit, wherein the first modular shelving unit and the second modular shelving unit have at least one shared vertical support member. including In some aspects, the techniques described herein relate to a method, wherein the at least one retaining arm includes a first retaining arm and a second retaining arm, the second retaining arm is positioned opposite the second retaining arm, and the method further including positioning the retaining bracket such that first retaining arm is positioned above the first modular shelf and the second retaining arm is positioned above the second modular shelf.

In some aspects, the techniques described herein relate to a method, wherein the method of securing the first modular shelf and the second modular shelf to the first modular shelving unit and the second modular shelving unit is repeated along either of the shared vertical member.

BRIEF DESCRIPTION OF THE DRAWINGS

Throughout the drawings, reference numbers are re-used to indicate correspondence between referenced elements. The drawings are provided to illustrate embodiments of the subject matter described herein and do not limit the scope thereof.

DETAILED DESCRIPTION OF SOME EMBODIMENTS

Overview

Figure 2:
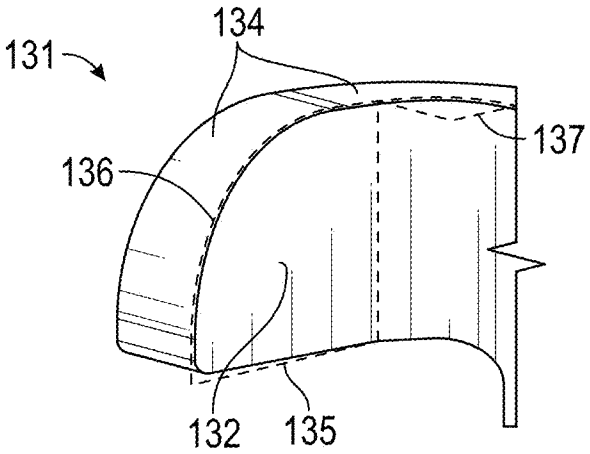
FIG. 2 illustrates a detailed view of a retaining arm of the retaining bracket of FIG. 1.

The disclosure provides designs, figures, and description that are non-limiting examples of some embodiments of a retaining bracket. Other embodiments of the retaining bracket may or may not include all of the features disclosed herein. Moreover, disclosed advantages and benefits may apply to only some embodiments of the retaining bracket, and should not be used to limit the scope of the disclosure or claims.

In accordance with certain features, aspects, and advantages of at least one of the embodiments disclosed herein, a modular shelving unit retaining bracket is disclosed. The retaining bracket can add rigidity to modular shelving units, which are traditionally insecurely fastened, while still providing enough flexibility to prevent unnecessary elastic deformation of members of the modular shelving unit. Traditional methods for connecting modular shelves onto modular shelving units comprise either interlocking gravity-assisted connections, or mechanical fastening. Gravity-assisted connections may not adequately ensure that the shelving units would remain intact or structurally sound upon being moved or disturbed, intentionally or by accident. Mechanically fastening modular shelves to the modular shelving units can introduce unnecessary stresses to the system at points of contact, leading to undesirable effects such as elastic deformation of, or fracture of, components of the shelving unit. As such, the disclosed retaining bracket can advantageously prevent the dislocation of modular shelves present in a gravity-assisted interlocking connection, without leading to the undue tension and elastic deformation which would occur if the shelves were mechanically fastened.

Furthermore, modular shelving units can be assembled in a series, not merely as standalone shelving units. When the shelves are assembled in series, an adjoining modular shelving unit can share one or more vertical support members with an adjacent modular shelving unit, which can reduce the costs and overall footprint of the modular shelving unit, while also adding rigidity to the entire system. The modular shelves can be connected to these shared vertical support members at one or more points of contact. Advantageously, the retaining bracket disclosed can provide rigidity to both modular shelving units which share the vertical support member. The retaining bracket can have a symmetrical design, which has retaining arms on both of its sides. As such, use of this retaining bracket advantageously cuts down on installation costs for adjoining modular shelving units, both in terms of materials cost and labor, as one bracket can provide rigidity to adjoining shelving units, and a single retaining bracket can be installed for two different shelves.

In accordance with another feature in this disclosure, a method of securely attaching a modular shelf to a modular shelving unit is disclosed. One embodiment of a modular shelving unit with which the disclosed retaining bracket is compatible is comprised of a plurality of modular shelves, a plurality of vertical support members, and a plurality of modular support pieces. The vertical support members can have connection interfaces (e.g., a threaded opening) for connecting one or more modular support pieces (e.g., shelves) to the vertical support members. The connecting interfaces can be positioned such that multiple shelves can be attached along a length of the vertical support member at different heights. The vertical support members can include one or more securing interfaces (e.g., slots with threaded inserts) at locations which can accommodate the mounting of a retaining brackets. Modular shelves can be securely attached to a modular shelving unit by first positioning a modular shelf on a plurality of modular support pieces which can optionally mechanically couple with the modular shelf, can be a gravity assisted attachment, or other mechanism for securing the modular shelf to the vertical support members. After positioning the modular shelf, a retaining bracket with retaining arms can be oriented such that it aligns with a securing interface of the vertical support member. Once aligned, the retaining bracket can be coupled to the vertical support member, such as by using a fastener that secures the retaining bracket with a securing interface on the vertical support member of the modular shelving unit. The retaining bracket can be positioned at a distance between a retaining surface of the retaining bracket and a top surface of the modular shelf that is small enough to prevent dislodging of the modular shelf when the retaining bracket is installed. Once secured, the retaining bracket can prevent the modular shelf from dislodging from its position in relation to the vertical support member and the modular shelving unit, while still advantageously having the added flexibility that a strict mechanical connection lacks. This mounting method can provide security in the connections between the members of the modular shelving unit for use in situations such as moving the assembly.

In some embodiments, the retaining surface of the retaining bracket can be the bottom surface of the retaining arm. In some embodiments, the retaining surface can be a top surface. This method is particularly advantageous when securing multiple shelves using the same retaining bracket. Utilizing the retaining bracket in this way provides additional benefits to assemblers of modular shelving units as well as customers purchasing the modular shelves, as this decreases the number of unique parts needed and thus lowers manufacturing and packaging costs.

In accordance with another feature in this disclosure, a method of securely attaching multiple modular shelves to adjacent modular shelving units is disclosed. For such method to be applicable, a first modular shelving unit and a second modular shelving unit must share at least one vertical support member. This method could be applied where the two modular shelving units are adjacent and would share one or more vertical support members. The adjacent shelving units each include at least one modular shelf positioned at the same height on at least one shared vertical support member. A retaining bracket can be oriented to be aligned with the at least one shared vertical support member of the first modular shelving unit and the second modular shelving unit and positioned such that the retaining bracket aligns with a securing interface on the at least one shared vertical support member of the first modular shelving unit and the second modular shelving unit. The retaining bracket can be coupled to the vertical support member such that a distance between a retaining surface of the retaining bracket and top surfaces of both the first modular shelf and the second modular shelf is small enough to prevent dislodging of either shelf. In some embodiments, the retaining surface of the retaining bracket could be the retaining arm top surface or bottom surface.

In accordance with any of the methods disclosed for securely attaching at least one shelf to at least one modular shelving unit disclosed, the process can be repeated upon additional vertical support members associated with the modular shelf to provide added rigidity to the modular shelving unit.

Retaining Bracket

Figure 4:
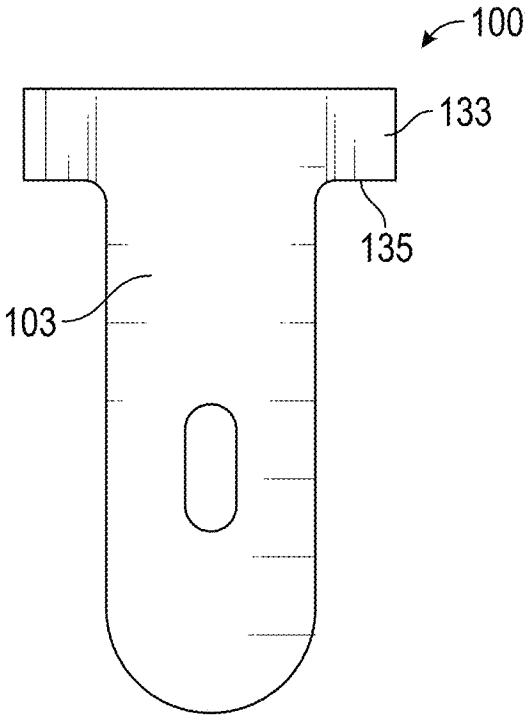
FIG. 4 illustrates a back view of the retaining bracket of FIG. 1.
Figure 3:
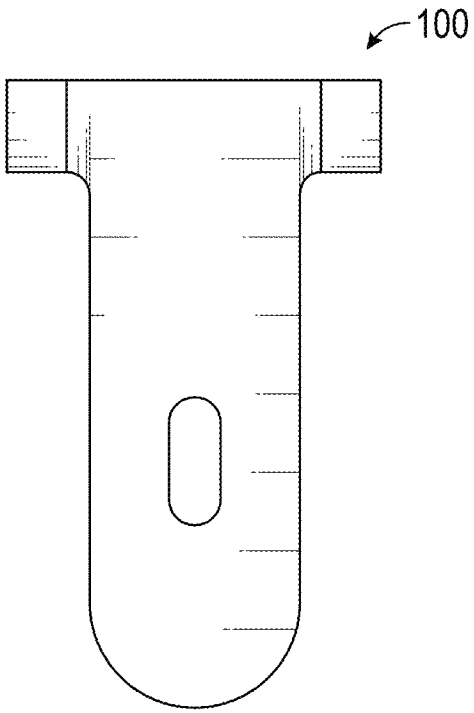
FIG. 3 illustrates a front view of the retaining bracket of FIG. 1.
Figure 5:
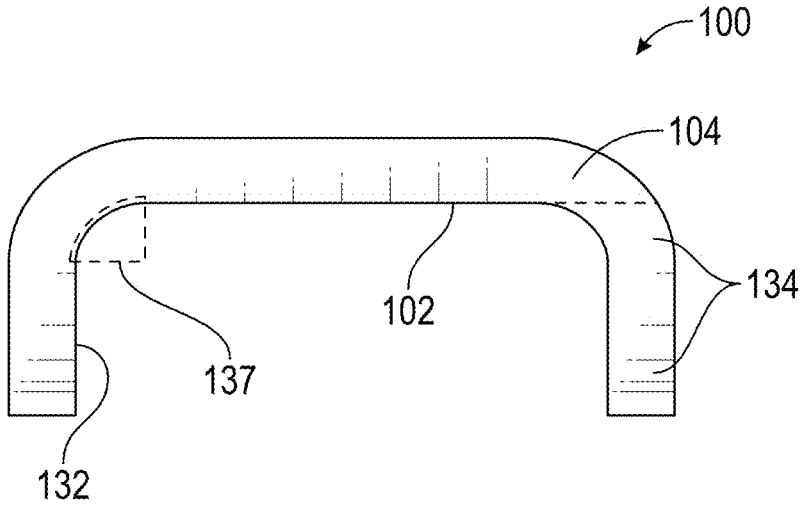
FIG. 5 illustrates a top view of the retaining bracket of FIG. 1.
Figure 6:
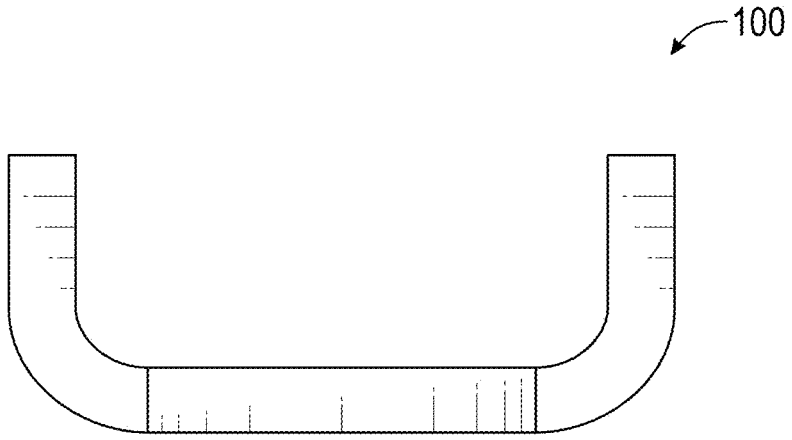
FIG. 6 illustrates a bottom view of the retaining bracket of FIG. 1.
Figure 7:
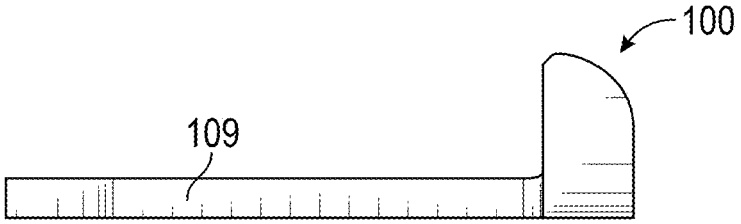
FIG. 7 illustrates a first side view of the retaining bracket of FIG. 1.
Figure 8:
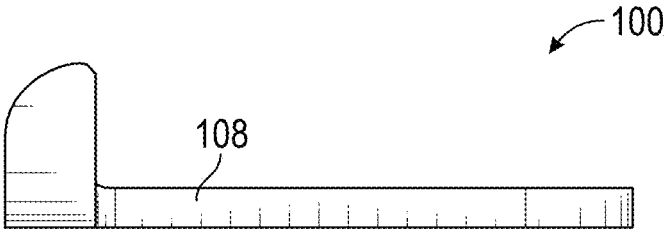
FIG. 8 illustrates a second side view of the retaining bracket of FIG. 1.

FIGS. 1 through 8 illustrate an embodiment of a retaining bracket 100. The retaining bracket can be used to secure a modular shelf 301 to a modular shelving unit 300 as illustrated in FIGS. 9-13. FIG. 3 depicts a front view and FIG. 4 depicts a back view, depicting the back body surface 103 and retaining arm outside surface 133. FIG. 5 depicts a top view of the retaining bracket 100. FIG. 6 depicts a bottom view of the retaining bracket 100. FIG. 7 depicts a second side view of the retaining bracket 100 with second side surface 109, and FIG. 8 depicts a first side view of the retaining bracket 100 with first side surface 108. The retaining bracket has a main body 101 comprising a front body surface 102, a back body surface 103, a top body surface 104, a bottom body surface 105, a proximal end 106, a distal end 107, a first side surface 108 and a second side surface 109. The retaining bracket 100 further comprises a head portion 130 located on the proximal end 106, which includes the retaining arms 131. The bottom body surface 105 can optionally comprise a curved surface with a first radius of curvature 110 between the first side surface 108 and second side surface 109. The head portion 130 is sized such that it can accommodate a vertical member 302 of the modular shelving unit 300 between retaining arms 131 (shown in FIGS. 9 through 12) once mounted.

The distal end 107 of the retaining bracket 100 comprises a securing interface. In the illustrated embodiment, the securing interface is a retaining bracket opening 111, which has an opening width 112, an opening length 113, an opening vertical position 114, and an opening horizontal position 115. The retaining bracket 100 can be mounted to a vertical support member 302 of the modular shelving unit 300 (shown in FIGS. 9 through 12) by mounting the retaining bracket 100 through its retaining bracket opening 111 to a complementary securing interface on the vertical support member 302 of the modular shelving unit 300. The opening vertical position 114 and opening horizontal position 115 are dimensioned such that the retaining bracket 100 can accommodate a modular shelf 301 when securely attaching the modular shelf 301 to a modular shelving unit 300.

Figure 1:
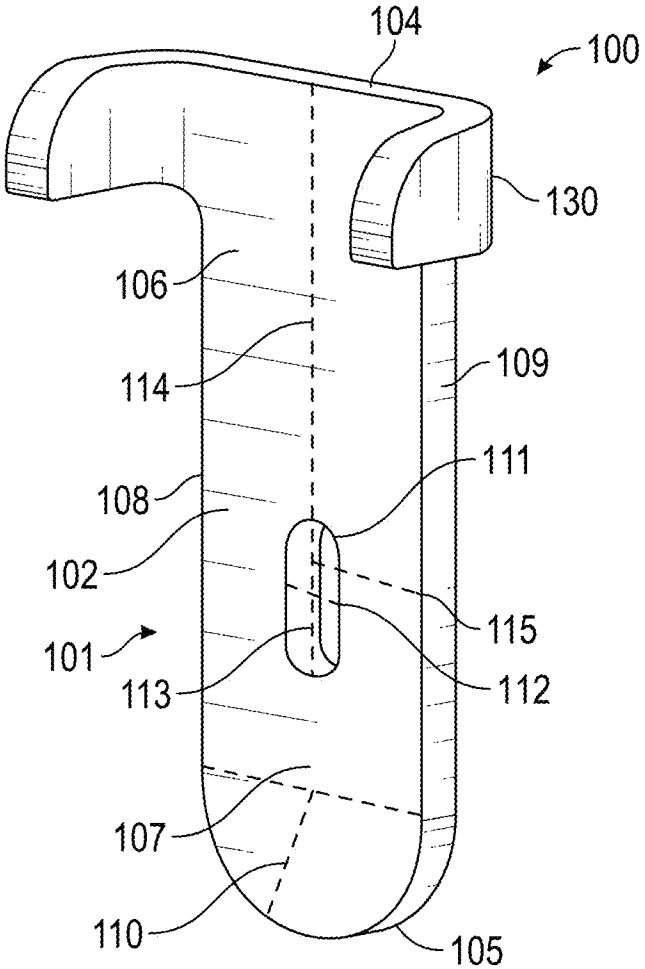
FIG. 1 illustrates a perspective view of an embodiment of a retaining bracket.

In an embodiment of the retaining bracket 100, the opening length 113 is not equal to the opening width 112. This can aid in positioning the retaining bracket 100, as accommodating dimensions can allow for the useability of a retaining bracket 100 which would otherwise fail to meet manufacturing tolerances or other unforeseeable complications during assembly of a modular shelving unit 300. The opening length 113 could allow the retaining bracket opening 111 to be an oblong slot, such as shown in FIG. 1. In an alternative embodiment, the opening width 112 and opening length 113 could be equivalent, such that the retaining bracket opening 111 is cylindrical.

FIG. 2 depicts a detailed view of the retaining arm 131. Two retaining arms 131 are present on the disclosed embodiment of retaining bracket 100 depicted in FIG. 2. The retaining arm 131 and the body 101 of the retaining bracket 100. are substantially perpendicular to each other. The retaining arm 131 depicted has a retaining arm inside surface 132, a retaining arm outside surface 133 (shown in FIG. 1), a retaining arm top surface 134, and a retaining arm bottom surface 135. The retaining arm top surface 134 depicted in this embodiment of a retaining arm 131 in FIG. 2 comprises both a rounded surface, which may have a defined radius of curvature 136, depicted by the dashed lines. The connection between the body 101 and the retaining arms 131 can have a transition portion. In the illustrated embodiment, the transition portion is a curved portion having a radius of curvature 137, as depicted by the dashed lines in FIG. 2. The radius of curvature 137 is configured to accommodate the vertical support member 302 of the modular shelving unit 300 (shown in FIGS. 9 through 12) upon the retaining bracket 100 being installed on a modular shelving unit 300. The angle between the retaining arm inside surface 132 and the body 101 can be substantially perpendicular. For example, the angle between the body 101 and the retaining arm 131 can be within 10 degrees of perpendicular, 5 degrees of perpendicular, 2 degrees of perpendicular, or as required or desired.

The retaining bracket 100 can be formed from metal, though it should be appreciated that they may be manufactured from other materials, such as plastic, wood, acrylic, or other types of materials. Indeed, any material capable of supporting the structure of the retaining bracket 100 may be used.

With reference to FIG. 5, a dashed line illustrates the distinction between the retaining bracket body 101 and retaining arm 131 components. The angle measured between the retaining arm inside surface 132 and the front body surface 102 is such that when the retaining bracket 100 is mounted to a vertical support member 302 of the modular shelving unit 300 (shown in FIGS. 9 through 12), the retaining arm 131 does not interfere with the vertical support member 302 of the modular shelving unit 300.

Figure 9:
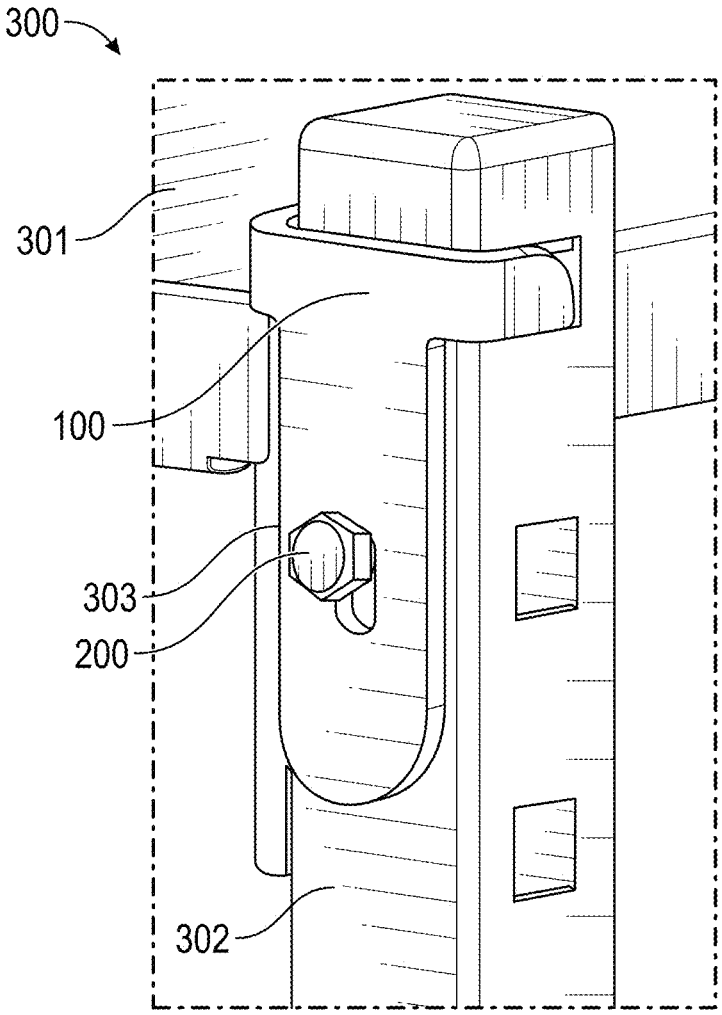
FIG. 9 illustrates the embodiment of the retaining bracket of FIG. 1 in use in a first configuration securely fastening a modular shelf to a modular shelving unit.
Figure 10:
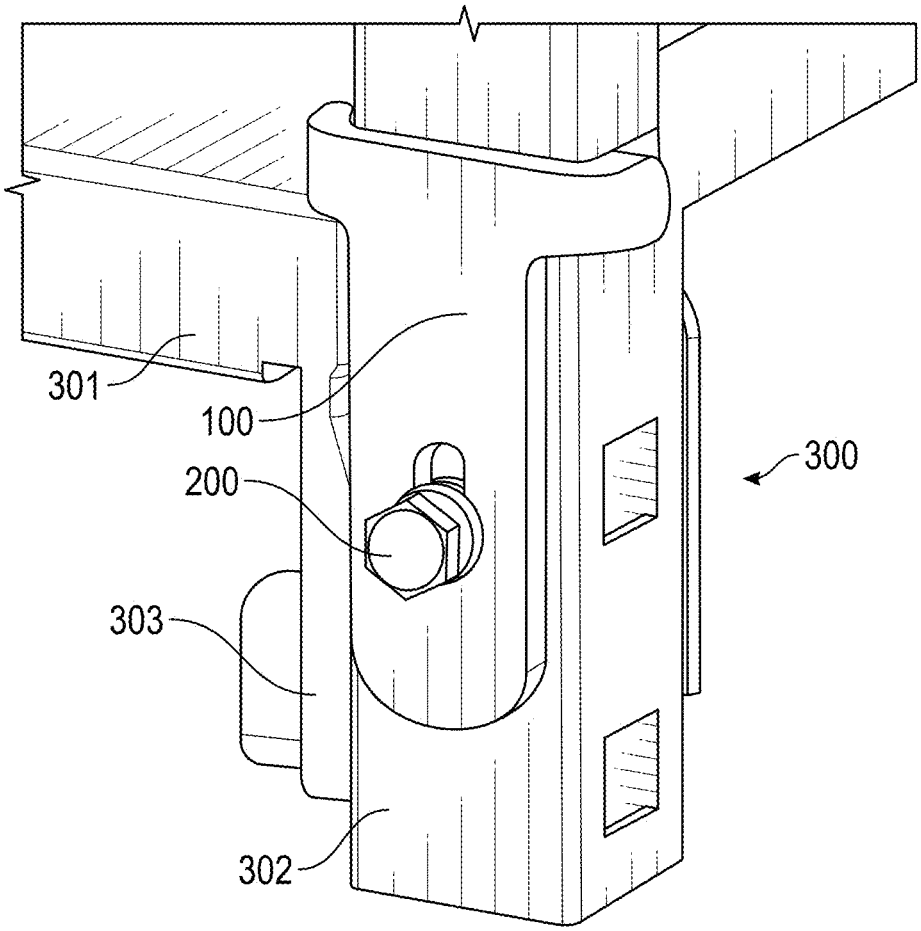
FIG. 10 illustrates the embodiment of the retaining bracket of FIG. 1 in use in a second configuration securely fastening a modular shelf to a modular shelving unit.
Figure 11:
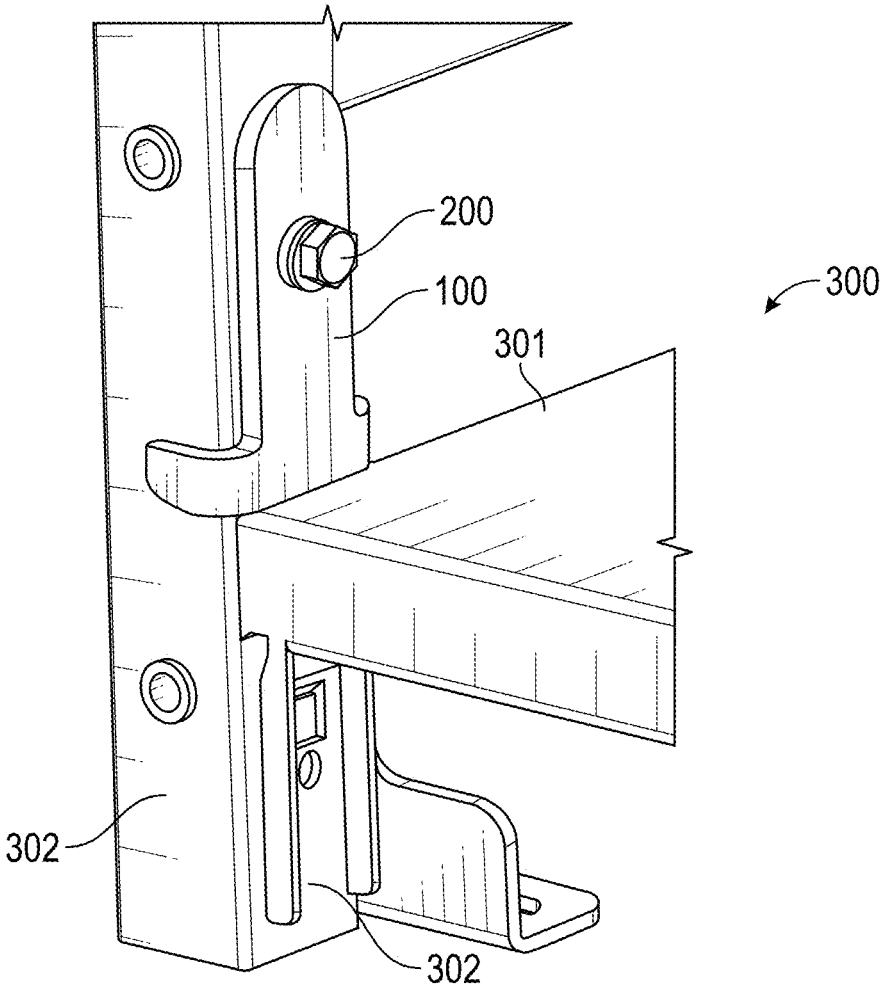
FIG. 11 illustrates the embodiment of the retaining bracket of FIG. 1 in use in a third configuration securely fastening a modular shelf to a modular shelving unit.
Figure 12:
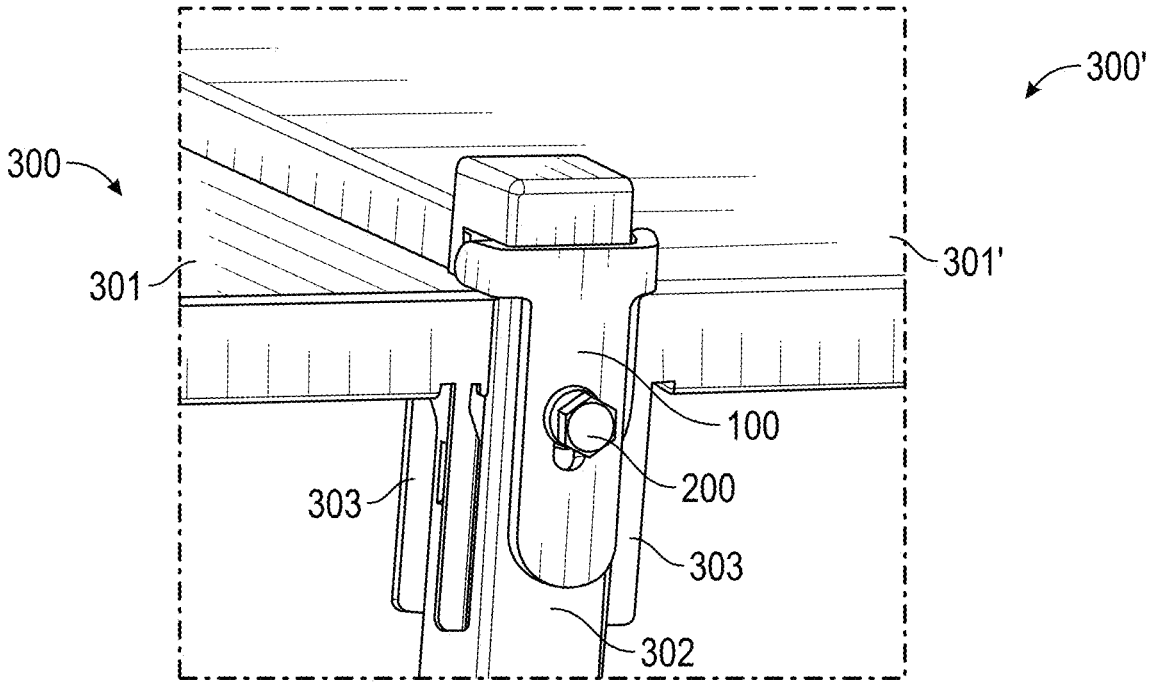
FIG. 12 illustrates the embodiment of the retaining bracket of FIG. 1 in use in a fourth configuration securely fastening a first modular shelf to a first modular shelving unit and a second modular shelf to an adjacent second modular shelving unit.

FIGS. 9 through 12 depict a modular shelving unit 300, with retaining bracket 100 installed using a mechanical coupling mechanism 200. The retaining bracket 100 depicted is used in a possible configuration for retaining a modular shelf 301 to a vertical member 302 of the modular shelving unit 300. The modular shelf 301 is depicted as resting on a modular support piece 303. The coupling mechanism 200 in these embodiments is a threaded bolt, which is screwed into mounting hardware installed in the vertical support member 302 of the modular shelving unit 300. Other types of coupling mechanisms may include magnets, pins, snaps, hook and loop fasteners, sliding locks, clips, fasteners, mating surfaces or members, or other types of mechanisms. The retaining surface of the retaining bracket 100 differs in each of FIGS. 9 through 12. In FIGS. 9, 10, and 12, the retaining surface of the retaining bracket 100 is the retaining arm bottom surface 135. In FIG. 11, the retaining surface of the retaining bracket 100 is the top body surface 104. FIG. 12 illustrates a retaining bracket positioned between a first modular shelving unit 300 with modular shelf 301 and a second modular shelving unit 300' with modular shelf 301'. A single retaining bracket 100 can be used to restrain both shelves.

Figure 13:
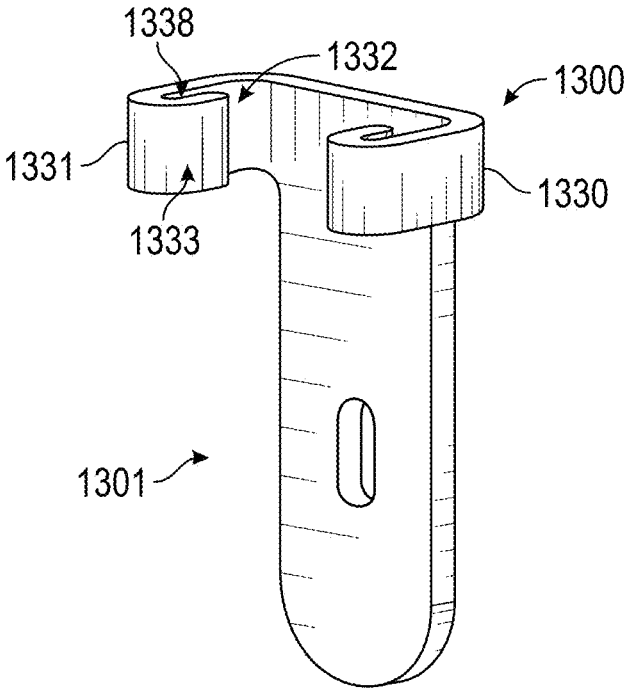
FIG. 13 illustrates an alternative embodiment of a retaining bracket.

FIG. 13 depicts an alternative embodiment of retaining bracket 1300, which has a main body 1301 substantially similar to the main body 101 of the retaining bracket 100. Where retaining bracket 1300 differs from retaining bracket 100 is in its head portion 1330, specifically its retaining arm 1331. The retaining arm 1331 of retaining bracket 1300 further comprises a rounded portion 1338 such that the retaining arm inside surface 1332 folds in on itself. Therefore, the retaining arm outside surface 1333 is the forwardmost surface of the retaining arm 1331. This additional feature does not interfere with the overall use of the retaining bracket 1300 in comparison to the retaining bracket 100.

Figure 14:
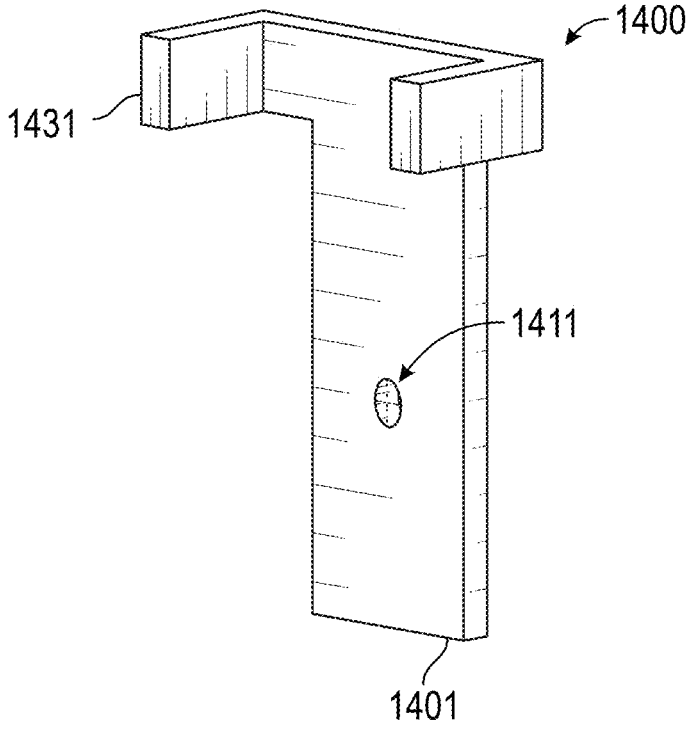
FIG. 14 illustrates an alternative embodiment of a retaining bracket.

FIG. 14 depicts another embodiment of the retaining bracket retaining bracket 1400. This retaining bracket 1400 is substantially similar to the retaining bracket 100 depicted in FIGS. 1 through 12, but differs in that it does not have rounded surfaces or a curved transition portion between the body 1401 and the arm 1431. Instead, the body 1401 is planar, and substantially perpendicular to both the left and right arms 1431. Furthermore, the retaining bracket opening 1411 is substantially circular.

Figure 15:
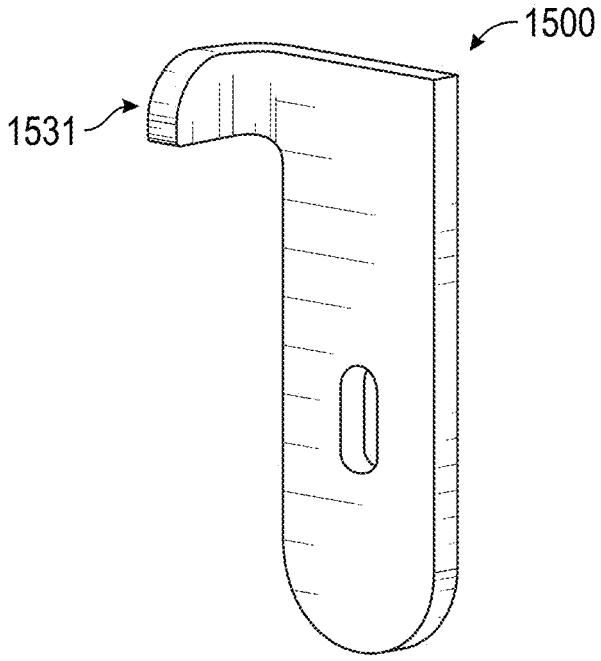
FIG. 15 illustrates an alternative embodiment of a retaining bracket.

FIG. 15 depicts another embodiment of a retaining bracket 1500. This retaining bracket 1500 is substantially similar to the retaining bracket 100 depicted in FIGS. 1 through 12, but differs in that it only comprises one retaining arm 1531 in its head portion 1530.

Figure 16:
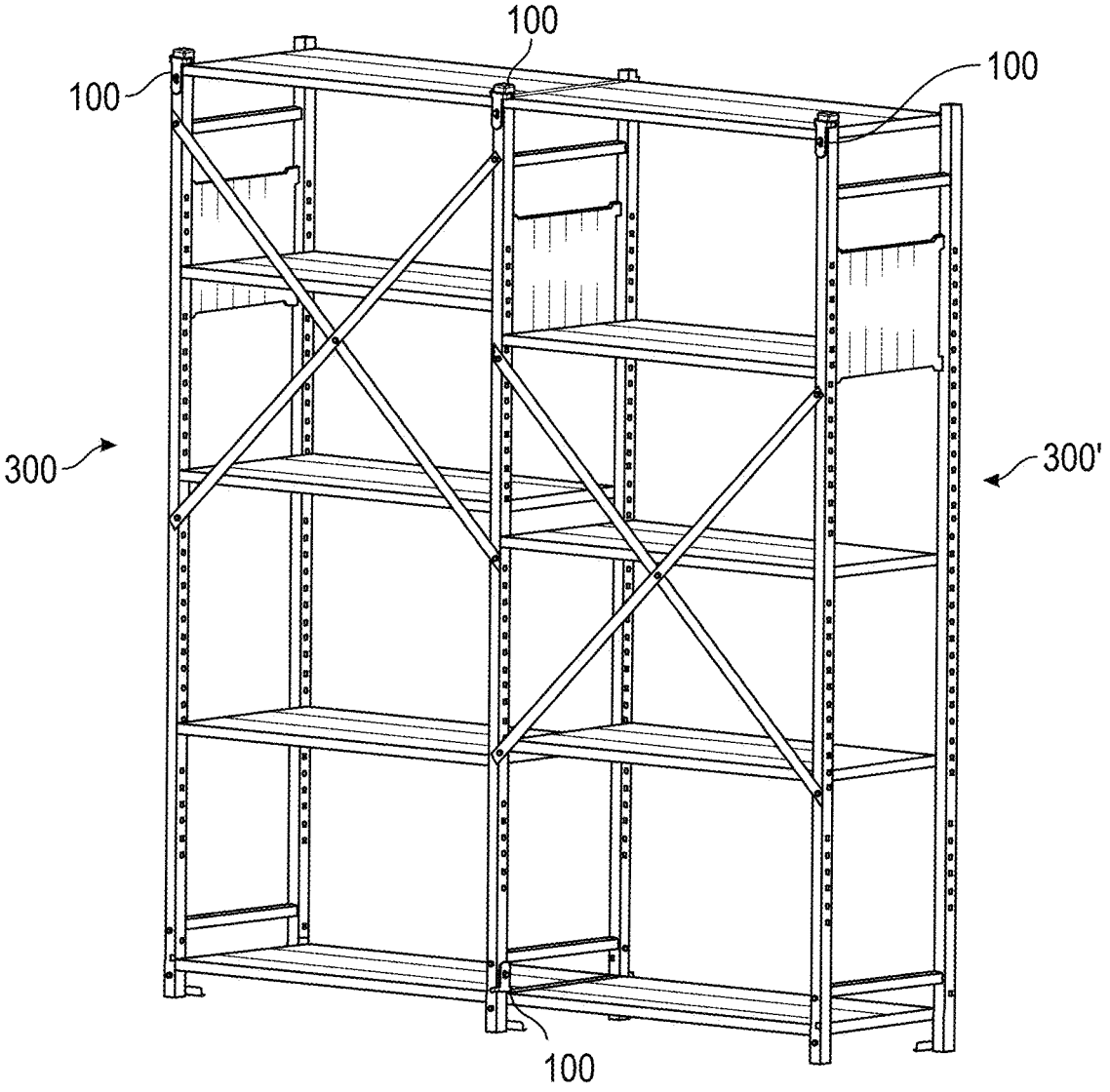
FIG. 16 illustrates an embodiment of the retaining bracket of FIG. 1 in use in a modular shelving unit in its entirety.

FIG. 16 depicts an isometric view of a model embodiment of a multitude of retaining brackets 100 in use in an embodiment of a first modular shelving unit 300 and a second modular shelving unit 300'. By using the retaining brackets 100 as shown, the modular shelves installed on the first modular shelving unit 300 and second modular shelving unit 300' are secured.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include these features, elements and/or states.

Conjunctive language such as the phrase "at least one of X, Y, and Z." unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

While the above detailed description may have shown, described, and pointed out novel features as applied to various embodiments, it may be understood that various omissions, substitutions, and/or changes in the form and details of any particular embodiment may be made without departing from the spirit of the disclosure. As may be recognized, certain embodiments may be embodied within a form that does not provide all of the features and benefits set forth herein, as some features may be used or practiced separately from others.

Additionally, features described in connection with one embodiment can be incorporated into another of the disclosed embodiments, even if not expressly discussed herein, and embodiments having the combination of features still fall within the scope of the disclosure. For example, features described above in connection with one embodiment can be used with a different embodiment described herein and the combination still fall within the scope of the disclosure.

It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this disclosure may comprise, additional to its essential features described herein, one or more features as described herein from each other embodiment disclosed herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added.

Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The scope of the present disclosure is not intended to be limited by the specific disclosures of preferred embodiments in this section or elsewhere in this specification and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Reference to any prior art in this description is not, and should not be taken as, an acknowledgement or any form of suggestion that that prior art forms part of the common general knowledge in the field of endeavor in any country in the world.

The invention may also be said broadly to consist in the parts, elements and features referred to or indicated in the description of the application, individually or collectively, in any or all combinations of two or more of said parts, elements or features.

Where, in the foregoing description, reference has been made to integers or components having known equivalents thereof, those integers are herein incorporated as if individually set forth. In addition, where the term "substantially" or any of its variants have been used as a word of approximation adjacent to a numerical value or range, it is intended to provide sufficient flexibility in the adjacent numerical value or range that encompasses standard manufacturing tolerances and/or rounding to the next significant figure, whichever is greater.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims.

What is claimed is:

1. A retaining bracket comprising:

a body portion, comprising a distal end having a securing interface, the securing interface configured to interface with a modular shelving unit to couple the body portion to the modular shelving unit by a mechanical coupling mechanism, and a head portion located at a proximal end of the body portion, the head portion comprising at least one retaining arm extending substantially perpendicular relative to the body portion, wherein the retaining bracket is configured to retain a modular shelf to the modular shelving unit with a retaining surface when the modular shelf is connected to the modular shelving unit by a gravity-assisted interlocking connection;

wherein the gravity-assisted interlocking connection is separate from and adjacent to the retaining bracket; and wherein the retaining surface of the retaining bracket is a bottom surface of the at least one retaining arm.

2. The retaining bracket of claim 1, wherein the securing interface is an opening that extends between a front surface and a back surface of the body portion.

3. The retaining bracket of claim 1, wherein the retaining bracket is symmetrical about a center axis, and wherein the at least one retaining arm includes a first retaining arm and a second retaining arm.

4. The retaining bracket of claim 1, wherein a transition portion between the at least one retaining arm and the body portion is rounded with a radius of curvature.

5. The retaining bracket of claim 1, wherein the retaining bracket is configured to couple with the modular shelving unit using a fastener.

6. The retaining bracket of claim 1, wherein the securing interface couples with a complementary securing interface on the modular shelving unit, wherein a distance between a retaining surface of the at least one retaining arm and a top surface of the modular shelf prevents dislodging of the modular shelf.

7. The retaining bracket of claim 1, wherein an angle formed between the at least one retaining arm and the body portion is between about 88 and 92 degrees.

8. A method of securely attaching a modular shelf to a modular shelving unit, comprising:

coupling the modular shelf to a plurality of vertical support members of the modular shelving unit by a gravity-assisted interlocking connection, orienting a securing interface of a retaining bracket with a complementary securing interface of a vertical support member of the modular shelving unit such that at least one retaining arm of the retaining bracket extends above at least a portion of a top surface of the modular shelf, coupling the retaining bracket to the vertical support member of the modular shelving unit, such that a distance between a retaining surface of the at least one retaining arm and the top surface of the modular shelf prevents removal of the modular shelf from the gravity-assisted interlocking connection on the vertical support member;

wherein the gravity-assisted interlocking connection is separate from and adjacent to the retaining bracket; and wherein the retaining surface of the retaining bracket is a retaining arm bottom surface.

9. The method of claim 8, wherein the retaining surface of the retaining bracket is a top surface of the at least one retaining arm.

10. The method of claim 8, wherein the method is repeated so that there is a plurality of retaining brackets securing the modular shelf.

11. The method of claim 8, further comprising attaching a first modular shelf and a second modular shelf to a first modular shelving unit and a second modular shelving unit, wherein the first modular shelving unit and the second modular shelving unit have at least one shared vertical support member.

12. The method of claim 11, wherein the at least one retaining arm comprises a first retaining arm and a second retaining arm, the second retaining arm positioned opposite the second retaining arm, and wherein the method further comprises positioning the retaining bracket such that the first retaining arm is positioned above the first modular shelf and the second retaining arm is positioned above the second modular shelf.

13. The method of claim 11, wherein the method of attaching the first modular shelf and the second modular shelf to the first modular shelving unit and the second modular shelving unit is repeated along either of the shared vertical member.

14. A retaining bracket comprising:

a body portion, comprising a distal end having a securing interface, the securing interface configured to interface with a modular shelving unit to couple the body portion to the modular shelving unit by a mechanical coupling mechanism, and a head portion located at a proximal end of the body portion, the head portion comprising a first retaining arm and a second retaining arm extending substantially perpendicular relative to the body portion, wherein the retaining bracket is configured to retain a modular shelf to the modular shelving unit with a retaining surface when the modular shelf is connected to the modular shelving unit by a gravity-assisted interlocking connection;

wherein the gravity-assisted interlocking connection is separate from and adjacent to the retaining bracket; and wherein the retaining bracket is symmetrical about a center axis.

15. The retaining bracket of claim 14, wherein the retaining surface of the retaining bracket is a is a top surface of the head portion of the retaining bracket.

16. The retaining bracket of claim 14, wherein the securing interface couples with a complementary securing interface on the modular shelving unit, wherein a distance between a retaining surface of one of the first retaining arm and the second retaining arm and a top surface of the modular shelf prevents dislodging of the modular shelf.

* * * * *